US011268737B2

(12) United States Patent
Matsuda et al.

(10) Patent No.: US 11,268,737 B2
(45) Date of Patent: Mar. 8, 2022

(54) REFRIGERATION CYCLE APPARATUS

(71) Applicant: Mitsubishi Electric Corporation, Tokyo (JP)

(72) Inventors: Takuya Matsuda, Tokyo (JP); Kosuke Tanaka, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 66 days.

(21) Appl. No.: 16/638,950

(22) PCT Filed: Sep. 26, 2017

(86) PCT No.: PCT/JP2017/034673

§ 371 (c)(1),
(2) Date: Feb. 13, 2020

(87) PCT Pub. No.: WO2019/064332

PCT Pub. Date: Apr. 4, 2019

(65) Prior Publication Data

US 2020/0191447 A1 Jun. 18, 2020

(51) Int. Cl.

| | |
|---|---|
| ***F25B 13/00*** | (2006.01) |
| ***F25B 49/02*** | (2006.01) |
| *F25B 47/02* | (2006.01) |

(52) U.S. Cl.

CPC ..... *F25B 13/00* (2013.01); *F25B 49/02* (2013.01); *F25B 47/02* (2013.01); (Continued)

(58) Field of Classification Search

CPC ..... F25B 13/00; F25B 49/02; F25B 47/02; F25B 2313/0231; F25B 2313/0233; (Continued)

(56) References Cited

U.S. PATENT DOCUMENTS 5,189,884 A * 3/1993 Sami ..... F24F 12/003 62/114
2013/0312443 A1 11/2013 Tamaki et al.
(Continued)

FOREIGN PATENT DOCUMENTS

EP 2 669 605 A1 12/2013
EP 2 767 773 A1 8/2014
(Continued)

OTHER PUBLICATIONS

Inoue et al., Heat Pump Type Bath Water Heating Device, Aug. 30, 1990, JPH02217751A, Whole Document (Year: 1990).*
(Continued)

*Primary Examiner* — Larry L Furdge
(74) *Attorney, Agent, or Firm* — Posz Law Group, PLC

(57) ABSTRACT

A refrigeration cycle apparatus includes a hot water tank, a heat source for heating water in the hot water tank, and a refrigeration cycle circuit that includes an indoor heat exchanger, a heat-source heat exchanger, and a water heat exchanger. The indoor heat exchanger may operate as a condenser. When an outside temperature is greater than a specified temperature, the refrigeration cycle apparatus operates in a first state in which the heat-source heat exchanger operates as an evaporator and the water heat exchanger does not operate. When the outside temperature is less than the specified temperature, the refrigeration cycle apparatus operates in a second state in which the water heat exchanger operates as an evaporator and refrigerant therein absorbs heat from water in the hot water tank heated by the heat source and the heat-source heat exchanger does not operate.

6 Claims, 7 Drawing Sheets

(52) U.S. Cl.
CPC ..... *F25B 2313/0231* (2013.01); *F25B 2313/0233* (2013.01); *F25B 2313/02741* (2013.01); *F25B 2313/0314* (2013.01); *F25B 2600/2513* (2013.01); *F25B 2700/21152* (2013.01)

(58) Field of Classification Search
CPC .... F25B 2313/02741; F25B 2313/0314; F25B 2600/2513; F25B 2700/21152; F25B 2313/003; F25B 2313/009; F25B 2313/02731; F25B 2700/2104; F25B 2700/2103; F25B 2700/2106; F25B 2700/1931
See application file for complete search history.

(56) References Cited

U.S. PATENT DOCUMENTS

| | | | | |
|---|---|---|---|---|
| 2014/0033750 | A1* | 2/2014 | Tanaka | F25B 41/20 62/151 |
| 2015/0330675 | A1* | 11/2015 | Tamaki | F25B 13/00 62/324.1 |
| 2019/0011148 | A1* | 1/2019 | Matsuda | F25B 47/02 |

FOREIGN PATENT DOCUMENTS

| | | | | |
|---|---|---|---|---|
| JP | S63189739 | A | * | 8/1988 |
| JP | H01-314868 | A | | 12/1989 |
| JP | H02217751 | A | * | 8/1990 |
| JP | H06-221709 | A | | 8/1994 |
| JP | S55-17126 | U | | 10/2002 |
| JP | 2006-275343 | A | | 10/2006 |
| JP | 2007-232265 | A | | 9/2007 |
| WO | 2012/111063 | A1 | | 7/2014 |

OTHER PUBLICATIONS

Makino et al., Heat Pump System, Aug. 5, 1988, JPS63189739A, Whole Document (Year: 1988).*
Office Action dated Jun. 16, 2020 issued in corresponding JP patent application No. 2019-545411 (and English translation).
Extended European Search Report dated Sep. 11, 2020 issued in corresponding EP application No. 17926949.3.
International Search Report of the International Searching Authority dated Dec. 26, 2017 for the corresponding International application No. PCT/JP2017/034673 (and English translation).

* cited by examiner

REFRIGERATION CYCLE APPARATUS

CROSS REFERENCE TO RELATED APPLICATION

This application is a U.S. national stage application of PCT/JP2017/034673 filed on Sep. 26, 2017, the contents of which are incorporated herein by reference.

TECHNICAL FIELD

The present disclosure relates to a refrigeration cycle apparatus that is configured to perform an air-conditioning operation of air-conditioning an indoor space using an indoor heat exchanger and a hot-water supply operation of heating water in a hot water storage tank using a water heat exchanger.

BACKGROUND ART

There has been known some refrigeration cycle apparatus that includes a heat-source heat exchanger and an indoor heat exchanger, and is configured to supply cooling energy or heating energy generated in the heat-source heat exchanger to the indoor heat exchanger and air-condition an indoor space using the indoor heat exchanger. In addition, among such refrigeration cycle apparatuses, there has been proposed some refrigeration cycle apparatus that further includes a hot water storage tank and a water heat exchanger and is configured to perform an air-conditioning operation of air-conditioning an indoor space using the indoor heat exchanger and a hot-water supply operation of supplying the heating energy generated in the heat-source heat exchanger to the water heat exchanger and heating water in the hot water storage tank using the water heat exchanger (see Patent Literature 1).

CITATION LIST

Patent Literature

Patent Literature 1: International Publication No. WO 2012/111063

SUMMARY OF INVENTION

Technical Problem

A refrigeration cycle circuit has a configuration in which refrigerant flowing through an evaporator receives heat from air supplied to the evaporator. The refrigeration cycle circuit has a characteristic that when a temperature difference between the air supplied to the evaporator and the refrigerant flowing through the evaporator decreases, a coefficient of performance (hereinafter, referred to as COP) is lowered. Here, in some refrigeration cycle apparatus capable of performing both of the air-conditioning operation and the hot-water supply operation, the heat-source heat exchanger is used as an evaporator during a heating operation of heating an indoor space and during a simultaneous heating and hot-water supply operation of simultaneously performing the heating operation and the hot-water supply operation. In such a refrigeration cycle apparatus capable of performing both of the air-conditioning operation and the hot-water supply operation, when the heating operation or the simultaneous heating and hot-water supply operation is performed under a low outdoor air temperature condition, the temperature difference between outdoor air and the refrigerant flowing through the heat-source heat exchanger decreases, and thus the COP lowers.

An object of the present disclosure, which has been made to solve the above-mentioned problem, is to provide a refrigeration cycle apparatus capable of improving a COP as compared with some refrigeration cycle apparatus, when a heating operation or a simultaneous heating and hot-water supply operation is performed under a low outdoor air temperature condition.

Solution to Problem

A refrigeration cycle apparatus of an embodiment of the present disclosure includes a hot water storage tank configured to store water, a heat source provided to the hot water storage tank and configured to heat water stored in the hot water storage tank, a refrigeration cycle circuit including an indoor heat exchanger, a heat-source heat exchanger, and a water heat exchanger provided to the hot water storage tank and configured to exchange heat with the water stored in the hot water storage tank, and a first temperature measurement device configured to measure a temperature in an installation environment of the heat-source heat exchanger. The refrigeration cycle apparatus is configured to operate in an operation mode in which the indoor heat exchanger is used as a condenser, and the operation mode is in a first operation state in which the heat-source heat exchanger is used as an evaporator, when a temperature measured by the first temperature measurement device is higher than a first specified temperature, and the operation mode is in a second operation state in which the water heat exchanger is used as an evaporator and refrigerant flowing through the water heat exchanger is evaporated by heat generated by the heat source, when the temperature measured by the first temperature measurement device is equal to or lower than the first specified temperature.

Advantageous Effects of Invention

The refrigeration cycle apparatus of an embodiment of the present disclosure can heat an indoor space using heat received by the refrigerant flowing through the water heat exchanger from the heat source, when the refrigeration cycle apparatus operates in the operation mode in which the indoor heat exchanger is used as a condenser under a condition in which a temperature measured by the first temperature measurement device is equal to or lower than the first specified temperature, that is, when the refrigeration cycle apparatus performs a heating operation or a simultaneous heating and hot-water supply operation under a low outdoor air temperature condition. The refrigeration cycle apparatus of an embodiment of the present disclosure can therefore improve a COP as compared with some refrigeration cycle apparatus when the heating operation or the simultaneous heating and hot-water supply operation is performed under a low outdoor air temperature condition.

DESCRIPTION OF EMBODIMENTS

Embodiment

Figure 1:
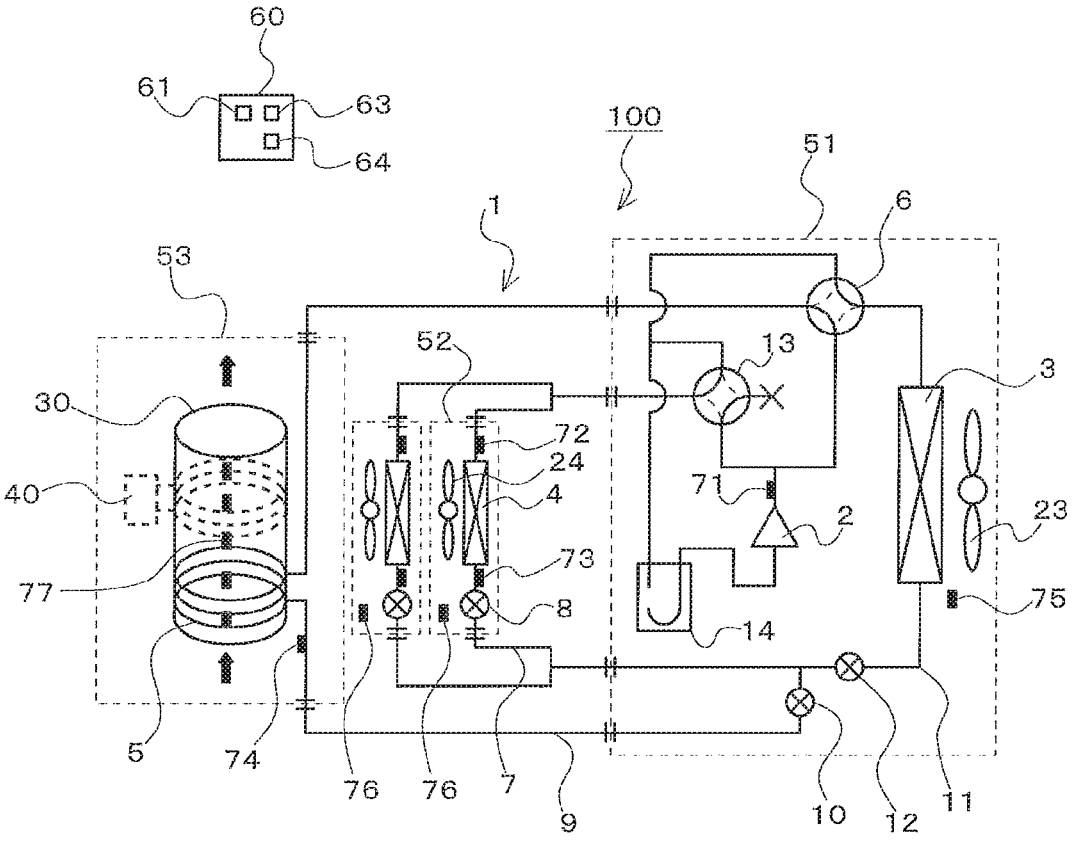
FIG. 1 is a refrigerant circuit diagram illustrating a refrigeration cycle apparatus according to an embodiment of the present disclosure.

FIG. 1 is a refrigerant circuit diagram illustrating a refrigeration cycle apparatus according to an embodiment of the present disclosure.

A refrigeration cycle apparatus 100 according to the present embodiment can perform a heating operation of heating an indoor space using indoor heat exchangers 4 and a hot-water supply operation of heating water in a hot water storage tank 30 using a water heat exchanger 5. This refrigeration cycle apparatus 100 includes the hot water storage tank 30, an electric heater 40, and a refrigeration cycle circuit 1.

The hot water storage tank 30 is configured to store water such as city water in the hot water storage tank 30. In the present embodiment, water such as city water is supplied to the hot water storage tank 30 from a lower portion of the hot water storage tank 30 as represented by solid arrows in FIG. 1. The water stored in the hot water storage tank 30 is heated by at least one of the electric heater 40 and the water heat exchanger 5 of the refrigeration cycle circuit 1. The water in the hot water storage tank 30 that has been heated to become hot water flows out of an upper portion of the hot water storage tank 30 as represented by the solid arrows in FIG. 1, and is supplied to a hot-water supply destination.

The electric heater 40 is provided to the hot water storage tank 30, and is configured to heat the water stored in the hot water storage tank 30. A heat generation portion of the electric heater 40 according to the present embodiment generates heat when electric power is supplied to the electric heater 40. The heat generation portion of the electric heater 40 is wound around an outer peripheral portion of the hot water storage tank 30. That is, when the electric power is supplied to the electric heater 40, an outer wall of the hot water storage tank 30 is heated by the heat generation portion, and the water in the hot water storage tank 30 is heated through the outer wall. Note that a supply source for supplying the electric power to the electric heater 40 is not particularly limited. For example, a commercial power supply may be used as the supply source, or a fuel cell may be used as the supply source. Moreover, the electric heater 40 may be provided in the hot water storage tank 30 to directly heat the water in the hot water storage tank 30.

The electric heater 40 corresponds to a heat source of the present disclosure. Note that the heat source of the present disclosure is not limited to the electric heater 40. For example, a gas boiler may be used as the heat source.

The refrigeration cycle circuit 1 includes a compressor 2, a heat-source heat exchanger 3, the indoor heat exchangers 4, the water heat exchanger 5, a flow path switching device 6, expansion valves 8, an expansion valve 10, and an expansion valve 12 as well as pipes connecting these components.

The compressor 2 is configured to suction refrigerant and compress the refrigerant into high-temperature and high-pressure gas refrigerant. The compressor 2 is not particularly limited in type. For example, various compression mechanisms such as reciprocating, rotary, scroll, and screw compression mechanisms may be used for the compressor 2. It is preferred that the compressor 2 be a compressor capable of variably controlling a rotation frequency using an inverter.

The flow path switching device 6 that is, for example, a four-way valve is connected to a discharge port of the compressor 2. The flow path switching device 6 is configured to switch a flow path between a first flow path represented by the dashed lines in FIG. 1 and a second flow path represented by the solid lines in FIG. 1. The first flow path is a flow path in which a first inflow-outflow port of the heat-source heat exchanger 3 is connected to the discharge port of the compressor 2 and a first inflow-outflow port of the water heat exchanger 5 is connected to a suction port of the compressor 2. The second flow path is a flow path in which the first inflow-outflow port of the heat-source heat exchanger 3 is connected to the suction port of the compressor 2 and the first inflow-outflow port of the water heat exchanger 5 is connected to the discharge port of the compressor 2. Note that the flow path switching device 6 is not limited to the four-way valve, and may be, for example, a combination of a plurality of two-way valves.

The heat-source heat exchanger 3 is, for example, a fin-tube air heat exchanger that is configured to exchange heat between refrigerant flowing inside the heat-source heat exchanger 3 and outdoor air. As described above, the first inflow-outflow port of the heat-source heat exchanger 3 is connected to the flow path switching device 6. In addition, as described later, a second inflow-outflow port of the heat-source heat exchanger 3 is connected to a pipe 11. Note that, in the present embodiment, a fan 23 configured to supply the outdoor air to the heat-source heat exchanger 3 is provided in the vicinity of the heat-source heat exchanger 3 to enhance heat exchange between the refrigerant and the outdoor air in the heat-source heat exchanger 3.

The indoor heat exchangers 4 are each, for example, a fin-tube air heat exchanger that is configured to exchange heat between refrigerant flowing inside the indoor heat exchanger 4 and indoor air. First inflow-outflow ports of the respective indoor heat exchangers 4 and the flow path switching device 6 are connected in parallel with each other and connected to the discharge port of the compressor 2. Moreover, second inflow-outflow ports of the respective indoor heat exchangers 4 are each connected to the corresponding one of first end portions of a pipe 7. Expansion valves 8 each configured to decompress and expand the refrigerant are provided to the pipe 7. In other words, the expansion valves 8 are each provided downstream of the corresponding one of the indoor heat exchangers 4 in a refrigerant flow direction in a state in which the indoor heat exchanger 4 is used as a condenser. Note that in the present embodiment, fans 24 configured to supply the indoor air to the respective indoor heat exchangers 4 are each provided in the vicinity of the corresponding one of the indoor heat exchangers 4 to enhance heat exchange between the refrigerant and the indoor air in the indoor heat exchangers 4.

The pipe 7 corresponds to a first pipe of the present disclosure. Moreover, the expansion valves 8 each correspond to a first expansion valve of the present disclosure.

The water heat exchanger 5 is provided to the hot water storage tank 30, and is configured to heat the water stored in the hot water storage tank 30. The water heat exchanger 5 according to the present embodiment is, for example, a pipe having a high thermal conductivity, and is wound around the outer peripheral portion of the hot water storage tank 30. That is, when the refrigerant having a temperature higher than a temperature of the water in the hot water storage tank 30 flows through the water heat exchanger 5, the outer wall of the hot water storage tank 30 is heated, and the water in the hot water storage tank 30 is heated through the outer wall. Note that the water heat exchanger 5 may be provided in the hot water storage tank 30 to directly heat the water in the hot water storage tank 30. As described above, the first inflow-outflow port of the water heat exchanger 5 is connected to the flow path switching device 6. A second inflow-outflow port of the water heat exchanger 5 is connected to a first end portion of the pipe 9. The expansion valve 10 configured to decompress and expand the refrigerant is provided to the pipe 9.

The pipe 9 corresponds to a second pipe of the present disclosure. Moreover, the expansion valve 10 corresponds to a second expansion valve of the present disclosure.

A second end portion of the pipe 7 and a second end portion of the pipe 9 are connected to a first end portion of the pipe 11. That is, the pipe 7 and the pipe 9 are connected in parallel with each other and connected to the pipe 11. A second end portion of the pipe 11 is, as described above, connected to a second end portion of the heat-source heat exchanger 3. Moreover, the expansion valve 12 is provided to the pipe 11. Note that, as described later, the expansion valve 12 is used with an opening degree in a fully-opened state or with an opening degree in a fully-closed state. An open-close valve may therefore be used in place of the expansion valve 12.

The pipe 11 corresponds to a third pipe of the present disclosure. Moreover, the expansion valve 12 corresponds to the open-close valve of the present disclosure.

Note that the refrigeration cycle apparatus 100 according to the present embodiment can perform not only the heating operation but also a cooling operation of cooling an indoor space using the indoor heat exchangers 4. Specifically, the refrigeration cycle circuit 1 of the refrigeration cycle apparatus 100 includes a flow path switching device 13 between the compressor 2 and the first inflow-outflow ports of the indoor heat exchangers 4. The flow path switching device 13 is configured to switch a flow path between a third flow path represented by the dashed lines and a fourth flow path represented by the solid lines in FIG. 1, The third flow path is a flow path in which the first inflow-outflow ports of the indoor heat exchangers 4 are connected to the discharge port of the compressor 2. The fourth flow path is a flow path in which the first inflow-outflow ports of the indoor heat exchangers 4 are connected to the suction port of the compressor 2. Note that in the present embodiment, the flow path switching device 13 is the four-way valve and operates by closing one connection port of the four-way valve. However, the flow path switching device 13 is not limited to the four-way valve, and may be, for example, a combination of a plurality of two-way valves.

In the refrigeration cycle circuit 1 of the refrigeration cycle apparatus 100 according to the present embodiment, an accumulator 14 configured to store surplus refrigerant is provided to the suction port of the compressor 2, more specifically, between the suction port of the compressor 2 and the flow path switching device 6. Note that, when the surplus refrigerant is hardly produced, the accumulator 14 may be omitted.

The components of the refrigeration cycle apparatus 100 described above are accommodated in a heat source unit 51, indoor units 52, and a hot water storage tank unit 53. More specifically, the heat source unit 51 accommodates the compressor 2, the heat-source heat exchanger 3, the flow path switching device 6, the expansion valve 10, the expansion valve 12, the flow path switching device 13, the accumulator 14, and the fan 23. The indoor units 52 each accommodate the corresponding one of the indoor heat exchangers 4, the corresponding one of the expansion valves 8, and the corresponding one of the fans 24. The hot water storage tank unit 53 accommodates the hot water storage tank 30, the water heat exchanger 5, and the electric heater 40.

Note that, in the present embodiment, two indoor units 52 are connected in parallel. However, in the present disclosure, the number of indoor units 52 is not limited to two. Three or more indoor units 52 may be connected in parallel, or only one indoor unit 52 may be provided. Moreover, in the present embodiment, only one heat source unit 51 and only one hot water storage tank unit 53 are provided. However, in the present disclosure, the number of heat source units 51 is not limited to one, and the number of hot water storage tank units 53 is not limited to one. Two or more heat source units 51 may be connected in parallel, and two or more hot water storage tank units 53 may be connected in parallel.

The refrigeration cycle apparatus 100 includes various sensors and a controller 60 configured to control components of the refrigeration cycle apparatus 100 on the basis of measurement values of these sensors.

Specifically, a pressure sensor 71 configured to measure a pressure of the refrigerant discharged from the compressor 2 is provided to the discharge port of the compressor 2. Pipes connecting the respective first inflow-outflow ports of the indoor heat exchangers 4 to the flow path switching device 13 are each provided with a temperature sensor 72 configured to measure a temperature of the refrigerant flowing in this pipe. Positions in the pipe 7 each between the corresponding one of the indoor heat exchangers 4 and the corresponding one of the expansion valves 8 are each provided with a temperature sensor 73 configured to measure the temperature of the refrigerant flowing through the corresponding one of these positions. A position in the pipe 9 between the water heat exchanger 5 and the expansion valve 10 is provided with a temperature sensor 74 configured to measure a temperature of the refrigerant flowing through this position.

A temperature sensor 75 configured to measure a temperature in an installation environment of the heat-source heat exchanger 3, in other words, a temperature of outdoor air is provided in the vicinity of the heat-source heat exchanger 3. Temperature sensors 76 each configured to measure a temperature of the indoor space are each provided to the corresponding one of the indoor units 52. A plurality of temperature sensors 77 are provided to a side surface portion of the hot water storage tank 30 to be arranged from above to below. The temperature sensors 72 to 77 are, for example, thermistors.

The temperature sensor 75 corresponds to a first temperature measurement device of the present disclosure. The temperature sensors 76 each correspond to a third temperature measurement device of the present disclosure. As described later, a computing section 63 of the controller 60 measures a temperature of the water stored in the hot water storage tank 30 on the basis of the temperatures measured by the temperature sensors 77. That is, the computing section 63 and the temperature sensors 77 correspond to a second temperature measurement device of the present disclosure. Note that a temperature measured by one of the plurality of temperature sensors 77 may be used as the temperature of the water stored in the hot water storage tank 30. In this case, the one of the plurality of temperature sensors 77 is used as the second temperature measurement device of the present disclosure.

The controller 60 is dedicated hardware or a central processing unit (CPU) (which is also referred to as a processing unit, an arithmetic device, a microprocessor, microcomputer, or a processor) that executes a program stored in a memory. The controller 60 is accommodated in, for example, the heat source unit 51.

When the controller 60 is the dedicated hardware, the controller 60 corresponds to, for example, a single circuit, a composite circuit, an application specific integrated circuit (ASIC), a field-programmable gate array (FPGA), or a combination of these circuits. The functional sections of the controller 60 may be individual pieces of hardware, or the functional sections may be a single piece of hardware.

When the controller 60 is a CPU, each function executed by the controller 60 is performed by software, firmware, or a combination of software and firmware. The software or the firmware is described as a program, and is stored in a memory. The CPU reads out and executes the program stored in the memory, to thereby perform the functions of the controller 60. The memory is, for example, a RAM, a ROM, a flash memory, an EPROM, an EEPROM, or other non-volatile or volatile semiconductor memory.

A part of the function of the controller 60 may be performed by the dedicated hardware, and another part of the function of the controller 60 may be performed by software or firmware.

The controller 60 according to the present embodiment includes, as the functional sections, a memory 61, the computing section 63, and a control section 64.

The memory 61 is configured to store a value used when, for example, the control section 64 controls an object to be controlled, and a mathematical formula, a table, or other information used by the computing section 63 for computing. Moreover, the memory 61 is configured to store initial settings of actuators given at the time of start of the operation modes described later. The computing section 63 is configured to compute a degree of superheat and a degree of subcooling of the refrigerant flowing out of the indoor heat exchangers 4 and the water heat exchanger 5 on the basis of measurement values of the above-mentioned various sensors. In addition, as described above, the computing section 63 is configured to measure the temperature of the water stored in the hot water storage tank 30 on the basis of the temperatures measured by the temperature sensors 77. The control section 64 is configured to control, in each operation mode described later, switching of the flow paths of the flow path switching devices 6 and 13, opening degrees of the expansion valves 8, 10, and 12, and a heating capacity (input amount of electric power) of the electric heater 40. Moreover, the control section 64 according to the present embodiment also controls the rotation frequencies of the compressor 2 and the fans 23 and 24.

[Description of Operation]

Next, operations of the refrigeration cycle apparatus 100 according to the present embodiment will be described.

The refrigeration cycle apparatus 100 according to the present embodiment operates in a heating operation mode, a hot-water supply operation mode, a simultaneous heating and hot-water supply operation mode, a cooling operation mode, and a simultaneous cooling and hot-water supply operation mode.

Hereinafter, the operation modes will be described with reference to the refrigerant circuit diagrams.

[Heating Operation Mode]

The heating operation mode is an operation mode in which the indoor heat exchangers 4 are each used as a condenser, and the indoor air is heated using the refrigerant flowing through the indoor heat exchangers 4 to heat the indoor space. In the heating operation mode according to the present embodiment, the operation state differs depending on the temperature of outdoor air, that is, the temperature measured by the temperature sensor 75. More specifically, when the temperature of outdoor air is not low, that is, when the temperature measured by the temperature sensor 75 is higher than a first specified temperature, the heating operation mode according to the present embodiment is in a first operation state in which the heat-source heat exchanger 3 is used as an evaporator. Moreover, when the temperature of outdoor air is low, that is, when the temperature measured by the temperature sensor 75 is equal to or lower than the first specified temperature, the heating operation mode according to the present embodiment is in a second operation state in which the water heat exchanger 5 is used as an evaporator to evaporate the refrigerant flowing through the water heat exchanger 5 using heat generated by the electric heater 40. Hereinafter, the first operation state, the second operation state, and a method of setting the first specified temperature will be explained in this order.

Figure 2:
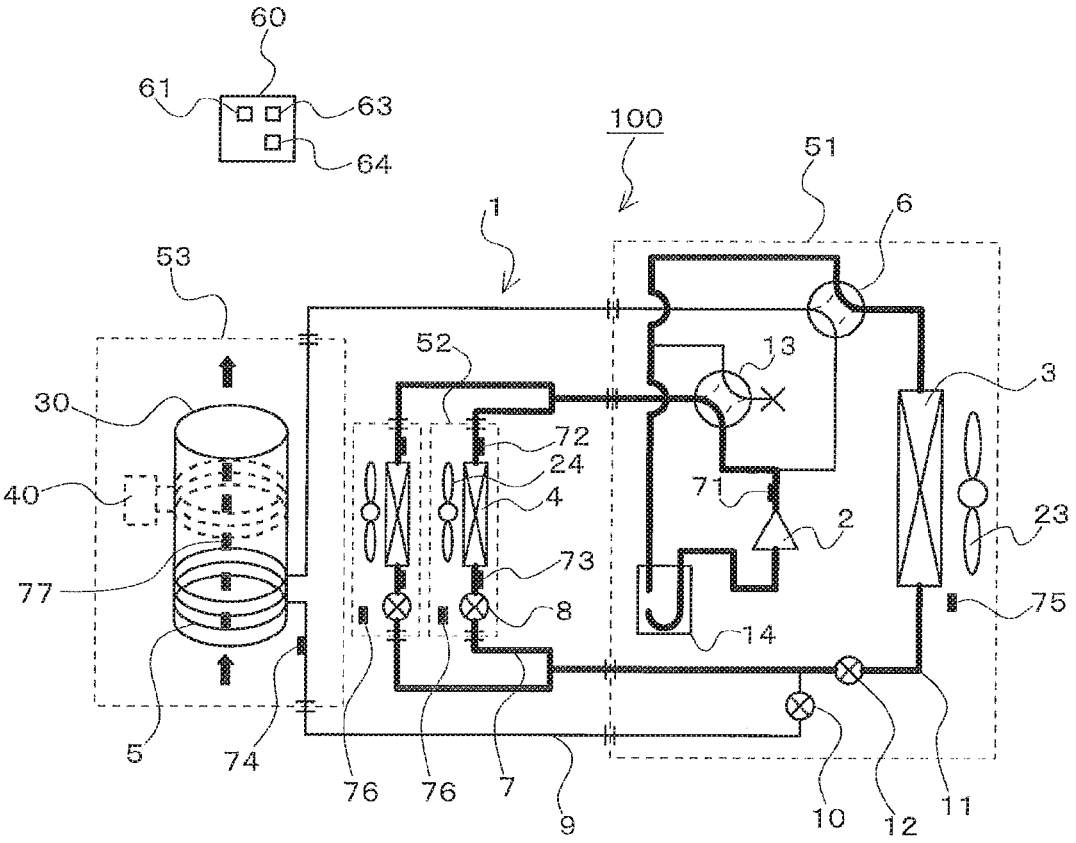
FIG. 2 is a refrigerant circuit diagram illustrating a first operation state in a heating operation mode of the refrigeration cycle apparatus according to the embodiment of the present disclosure.

FIG. 2 is a refrigerant circuit diagram illustrating the first operation state in the heating operation mode of the refrigeration cycle apparatus according to the embodiment of the present disclosure. In FIG. 2, the pipes illustrated with bold lines are pipes through which the refrigerant flows.

In the case where the temperature measured by the temperature sensor 75 is higher than the first specified temperature when the heating operation is to be started, the control section 64 controls the flow path switching device 6, the flow path switching device 13, the expansion valves 8, the expansion valve 10, and the expansion valve 12 on the basis of an initial state of the first operation state in the heating operation mode stored in the memory 61.

Note that the first specified temperature is stored in the memory 61. The computing section 63 compares the temperature measured by the temperature sensor 75 with the first specified temperature.

More specifically, the control section 64 switches the flow path of the flow path switching device 6 so that the flow path switching device 6 forms the second flow path represented by the solid lines in FIG. 1. Moreover, the control section 64 switches the flow path of the flow path switching device 13 so that the flow path switching device 13 forms the third flow path represented by the dashed lines in FIG. 1. The control section 64 sets the opening degree of each of the expansion valves 8 to an initial opening degree, for example, to an opening degree opened by a specified degree. Moreover, the control section 64 sets the opening degree of the expansion valve 10 to a fully closing degree, and the opening degree of the expansion valve 12 to a fully opening degree. Then, the control section 64 activates the compressor 2 and the fans 23 and 24 to start the heating operation. As the heating operation is performed, the indoor heat exchangers 4 are each used as a condenser, and the heat-source heat exchanger 3 is used as an evaporator.

Specifically, high-temperature and high-pressure gas refrigerant having been compressed in the compressor 2 passes through the flow path switching device 13 and flows into the indoor heat exchangers 4. Then, the high-temperature and high-pressure gas refrigerant flowing into the indoor heat exchangers 4 heats the indoor air, that is, heats the indoor space, turns in refrigerant in a liquid state, and flows out of the indoor heat exchangers 4. The refrigerant flowing out of the indoor heat exchangers 4 flows into the respective expansion valves 8. The liquid refrigerant flowing into the respective expansion valves 8 is decompressed in the expansion valves 8 to be in a low-temperature two-phase gas-liquid state, and flows out of the expansion valves 8.

At this time, the control section 64 controls the opening degree of each of the expansion valves 8 so that the degree of subcooling of the refrigerant at an outlet of the corresponding one of the indoor heat exchangers 4 is set to a specified value stored in the memory 61. The degree of subcooling is computed by the computing section 63. More specifically, the computing section 63 computes a condensing temperature of the refrigerant flowing through the indoor heat exchangers 4 on the basis of a pressure measured by the pressure sensor 71, that is, a value of pressure of the refrigerant discharged from the compressor 2. Moreover, the computing section 63 acquires a temperature measured by each of the temperature sensors 73, that is, a temperature of the refrigerant flowing out of the corresponding one of the indoor heat exchangers 4. Then, the computing section 63 subtracts the temperature measured by each of the temperature sensors 73 from the condensing temperature to obtain the degree of subcooling of the refrigerant at the outlet of the corresponding one of the indoor heat exchangers 4. Note that the method of obtaining the degree of subcooling is merely an example. For example, a temperature sensor may be provided at a position in any one of the indoor heat exchangers 4 at which the two-phase gas-liquid refrigerant flows, and a temperature measured by the temperature sensor may be used as the condensing temperature.

The low-temperature two-phase gas-liquid refrigerant flowing out of each of the expansion valves 8 passes through the pipe 7, the pipe 11, and the expansion valve 12, and flows into the heat-source heat exchanger 3. The low-temperature two-phase gas-liquid refrigerant flowing into the heat-source heat exchanger 3 absorbs heat from the outdoor air, is caused to be evaporated, and then flows out as low-pressure gas refrigerant from the heat-source heat exchanger 3. The low-pressure gas refrigerant flowing out of the heat-source heat exchanger 3 passes through the flow path switching device 6 and the accumulator 14, and is suctioned into the compressor 2.

Here, the refrigeration cycle circuit typically has a characteristic that when a temperature difference between the air supplied to the evaporator and the refrigerant flowing through the evaporator decreases, a coefficient of performance (hereinafter, referred to as COP) is lowered. That is, in the case where the refrigeration cycle apparatus 100 according to the present embodiment performs the heating operation, the COP of the refrigeration cycle circuit 1 is lowered when the temperature difference between the refrigerant flowing through the heat-source heat exchanger 3 used as an evaporator and the outdoor air decreases. That is, when the heating operation is performed in the first operation state under the low outdoor air temperature condition, the COP of the refrigeration cycle apparatus 100 is lowered.

In particular, when the temperature of outdoor air is so low to cause formation of frost on the heat-source heat exchanger 3, the formation of frost on the heat-source heat exchanger 3 leads to a reduction in the efficiency of heat exchange in the heat-source heat exchanger 3, and thus the COP of the refrigeration cycle apparatus 100 further lowers. When the formation of frost on the heat-source heat exchanger 3 proceeds, the heating operation cannot be performed. Thus, the heat-source heat exchanger 3 needs to be defrosted. At this time, when the heat-source heat exchanger 3 is to be defrosted using some techniques, a reverse operation of allowing high-temperature refrigerant having been discharged from the compressor 2 to flow into the heat-source heat exchanger 3 is performed to melt the frost deposited on the heat-source heat exchanger 3 by heat of the high-temperature refrigerant. It is therefore necessary to stop the heating operation during defrosting of the heat-source heat exchanger 3, and thus the COP of the refrigeration cycle apparatus 100 further lowers.

Thus, the refrigeration cycle apparatus 100 according to the present embodiment performs the heating operation in the second operation state when the temperature of outdoor air is low, that is, when the temperature measured by the temperature sensor 75 is equal to or lower than the first specified temperature.

Figure 3:
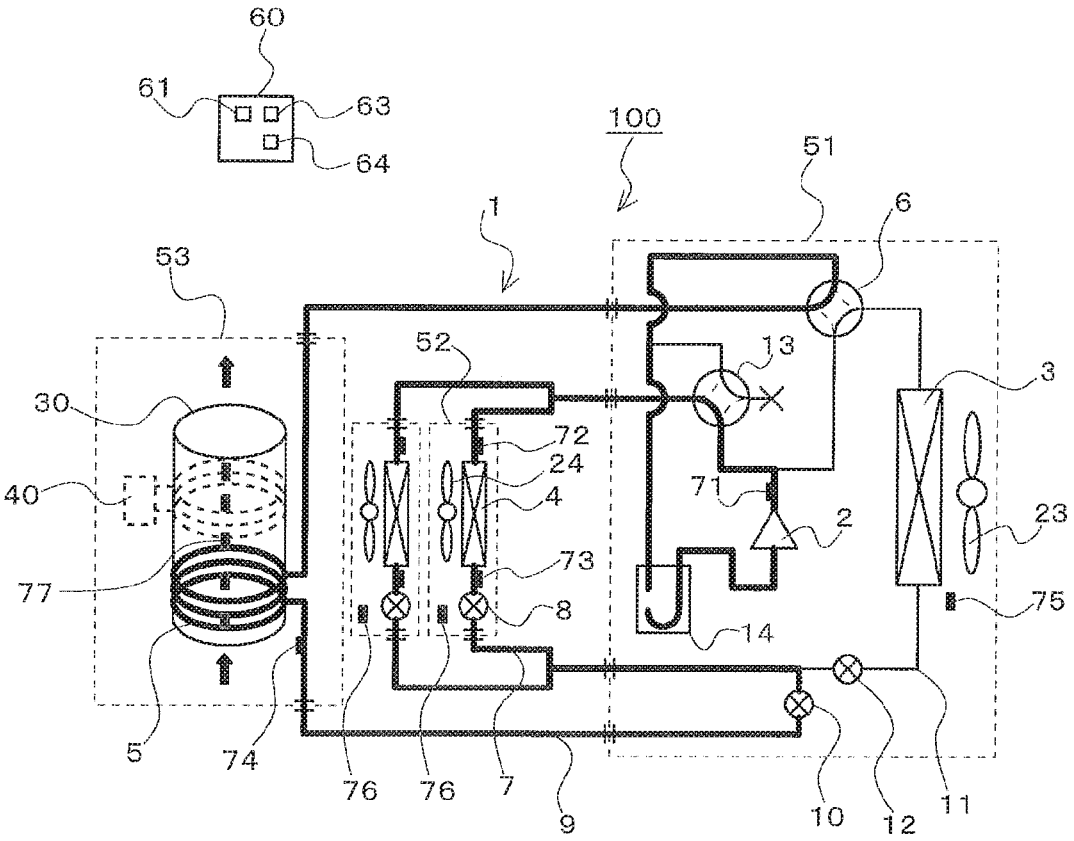
FIG. 3 is a refrigerant circuit diagram illustrating a second operation state in the heating operation mode of the refrigeration cycle apparatus according to the embodiment of the present disclosure.

FIG. 3 is a refrigerant circuit diagram illustrating the second operation state in the heating operation mode of the refrigeration cycle apparatus according to the embodiment of the present disclosure. In FIG. 3, the pipes illustrated with bold lines are pipes through which the refrigerant flows.

In the case where the temperature measured by the temperature sensor 75 is equal to or lower than the first specified temperature when the heating operation is to be started, the control section 64 controls the flow path switching device 6, the flow path switching device 13, the expansion valves 8, the expansion valve 10, and the expansion valve 12 on the basis of an initial state of the second operation state in the heating operation mode stored in the memory 61. In addition, the control section 64 supplies the electric power to the electric heater 40.

More specifically, the control section 64 switches the flow path of the flow path switching device 6 so that the flow path switching device 6 forms the first flow path represented by the dashed lines in FIG. 1. Moreover, the control section 64 switches the flow path of the flow path switching device 13 so that the flow path switching device 13 forms the third flow path represented by the dashed lines in FIG. 1. The control section 64 sets the opening degree of each of the expansion valves 8 to an initial opening degree, for example, to an opening degree opened by a specified degree. Moreover, the control section 64 sets the opening degree of the expansion valve 10 to a fully opening degree, and the opening degree of the expansion valve 12 to a fully closing degree. Then, the control section 64 activates the compressor 2 and the fans 23 and 24 to start the heating operation. As the heating operation is performed, the indoor heat exchangers 4 are each used as a condenser, and the water heat exchanger 5 is used as an evaporator to cause the refrigerant flowing through the water heat exchanger 5 to be evaporated by heat generated by the electric heater 40.

Specifically, high-temperature and high-pressure gas refrigerant having been compressed in the compressor 2 passes through the flow path switching device 13 and flows into the indoor heat exchangers 4. Then, the high-temperature and high-pressure gas refrigerant flowing into the indoor heat exchangers 4 heats the indoor air, that is, heats the indoor space, turns in refrigerant in a liquid state, and flows out of the indoor heat exchangers 4. The refrigerant flowing out of the indoor heat exchangers 4 flows into the respective expansion valves 8. The liquid refrigerant flowing into the respective expansion valves 8 is decompressed in the expansion valves 8 to be in a low-temperature two-phase gas-liquid state, and flows out of the expansion valves 8. At this time, the control section 64 controls the opening degree of each of the expansion valves 8 in a manner similar to the manner in the first operation state in the heating operation mode.

The low-temperature two-phase gas-liquid refrigerant flowing out of each of the expansion valves 8 passes through the pipe 7, the pipe 9, and the expansion valve 10, and flows into the water heat exchanger 5. Here, in the second operation mode, the electric power is supplied to the electric heater 40. Heat generated by the electric heater 40 is therefore transferred to the outer wall of the hot water storage tank 30 and the water stored in the hot water storage tank 30 and heats the outer wall and the water. Thus, the low-temperature two-phase gas-liquid refrigerant flowing into the water heat exchanger 5 absorbs heat from the outer wall of the hot water storage tank 30 and the water stored in the hot water storage tank 30, and is caused to be evaporated. That is, the low-temperature two-phase gas-liquid refrigerant flowing into the water heat exchanger 5 is evaporated by heat generated by the electric heater 40. At this time, when the amount of heat dissipated by the electric heater 40 and the amount of heat absorbed by the water heat exchanger 5 are equal to each other, the temperature of the water in the hot water storage tank 30 can be maintained constant. That is, decrease in temperature of the water in the hot water storage tank 30 can be prevented.

The refrigerant having evaporated in the water heat exchanger 5 flows out as low-pressure gas refrigerant from the water heat exchanger 5. The low-pressure gas refrigerant flowing out of the water heat exchanger 5 passes through the flow path switching device 6 and the accumulator 14 and is suctioned into the compressor 2.

In this manner, in the second operation state, the heating operation can be performed without using the heat-source heat exchanger 3 as an evaporator. The COP of the refrigeration cycle apparatus 100 can therefore be improved as compared with some refrigeration cycle apparatus.

Next, a method of setting the first specified temperature will be described.

Figure 4:
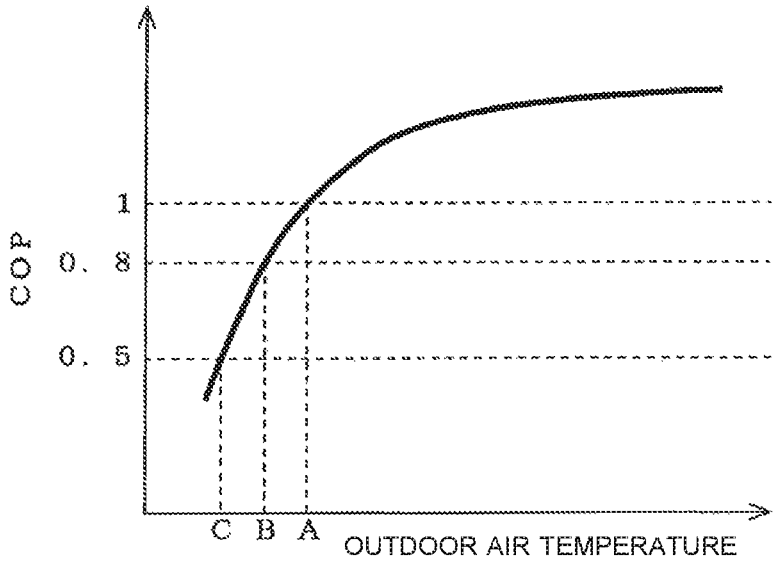
FIG. 4 is a graph showing a relationship between a temperature of outdoor air and a COP of the refrigeration cycle apparatus according to the embodiment of the present disclosure.

FIG. 4 is a graph showing a relationship between the temperature of outdoor air and the COP of the refrigeration cycle apparatus according to the embodiment of the present disclosure.

A bold solid line shown in FIG. 4 represents a COP of the refrigeration cycle circuit 1 when the heat-source heat exchanger 3 is used as an evaporator. As represented by the bold solid line, as the temperature of outdoor air is lowered, the temperature difference between the refrigerant flowing through the heat-source heat exchanger 3 used as an evaporator and the outdoor air decreases, and thus the COP of the refrigeration cycle circuit 1 lowers. When the temperature of outdoor air becomes equal to or lower than "A," the COP of the refrigeration cycle circuit 1 becomes equal to or less than 1. On the other hand, when the heating operation is performed using the electric heater 40, the COP is theoretically 1 regardless of the temperature of outdoor air. In the present embodiment, heat is exchanged between the electric heater 40 and the refrigerant flowing through the water heat exchanger 5 through the outer wall of the hot water storage tank 30 and the water stored in the hot water storage tank 30. In the present embodiment, when the heating operation is performed using the electric heater 40, the COP including heat exchange loss therefore becomes 0.8. When the first specified temperature is set at "B," the COP of the refrigeration cycle apparatus 100 can be improved as compared with some refrigeration cycle apparatus, accordingly.

Here, as the heat exchange loss differs depending on the installation configuration of the electric heater 40, the heat exchange loss may be 50% at a maximum. Thus, when the first specified temperature is set to correspond to the COP of the refrigeration cycle circuit 1 that is in a range from 0.5 to 1.0 inclusive, that is, when the first specified temperature is set to be equal to or higher than "C" and equal to or lower than "A," the COP of the refrigeration cycle apparatus 100 can be improved as compared with some refrigeration cycle apparatus. In the refrigeration cycle apparatus 100 according to the present embodiment, "A" is 0 degrees C., "B" is −5 degrees C., and "C" is −10 degrees C.

Note that the first specified temperature differs depending on what is used as a heat source of the present disclosure. For example, when a gas boiler is used as the heat source, the first specified temperature is preferably set as follows.

Figure 5:
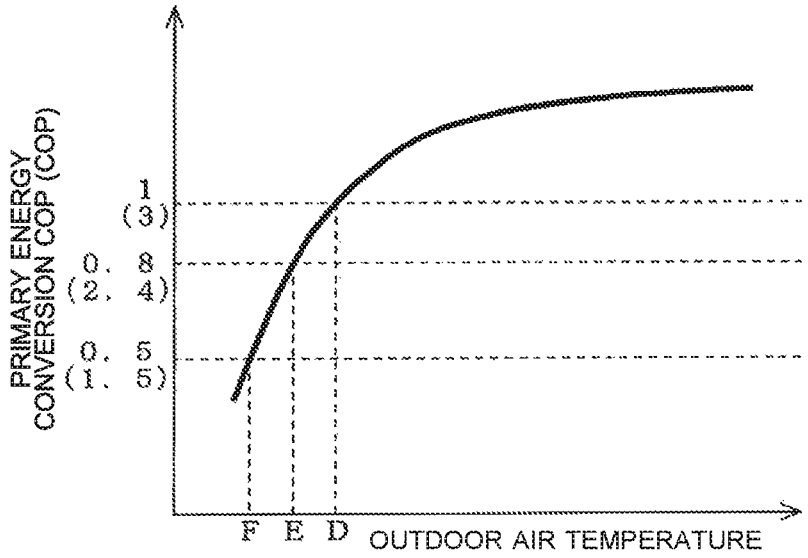
FIG. 5 is another graph showing a relationship between a temperature of outdoor air and a COP of the refrigeration cycle apparatus according to the embodiment of the present disclosure.

FIG. 5 is another graph showing a relationship between a temperature of outdoor air and a COP of the refrigeration cycle apparatus according to the embodiment of the present disclosure. Here, a primary energy conversion COP represented by the vertical axis of FIG. 5 is a value obtained by converting the COP of the refrigeration cycle circuit 1 into primary energy. In addition, in the vertical axis, a value in parentheses represents a COP of the refrigeration cycle circuit 1 before the COP is converted into the primary energy. Note that in the present embodiment, the primary energy conversion COP of the refrigeration cycle circuit 1 is obtained by multiplying the COP of the refrigeration cycle circuit 1 by a primary energy conversion coefficient 0.33.

When the heating operation is performed using a gas boiler, the COP theoretically corresponds to 1 that is the primary energy conversion COP of the refrigeration cycle circuit 1 regardless of the temperature of outdoor air. In the present embodiment, heat is exchanged between the gas boiler and the refrigerant flowing through the water heat exchanger 5 through the outer wall of the hot water storage tank 30 and the water stored in the hot water storage tank 30, In the present embodiment, when the heating operation is performed using the gas boiler, the COP including heat exchange loss therefore corresponds to 0.8 that is the primary energy conversion COP of the refrigeration cycle circuit 1. When the first specified temperature is set at "E," the COP of the refrigeration cycle apparatus 100 can be improved as compared with some refrigeration cycle apparatus, accordingly.

Here, as the heat exchange loss differs depending on the installation configuration of the gas boiler, the heat exchange loss may be 50% at a maximum, Thus, when the first specified temperature is set to correspond to the primary energy conversion COP of the refrigeration cycle circuit 1 that is in a range from 0.5 to 1.0 inclusive, the COP of the refrigeration cycle apparatus 100 can be improved as compared with some refrigeration cycle apparatus. In other words, when the first specified temperature is set to correspond to the COP of the refrigeration cycle circuit 1 that is in a range from 1.5 to 3.0 inclusive, that is, when the first specified temperature is set to be equal to or higher than "F" and equal to or lower than "D," the COP of the refrigeration cycle apparatus 100 can be improved as compared with some refrigeration cycle apparatus. In the refrigeration cycle apparatus 100 according to the present embodiment, "D" is 5 degrees C., "E" is 0 degrees C., and "F" is −5 degrees C.

[Hot-Water Supply Operation Mode]

The hot-water supply operation mode is an operation mode in which the water stored in the hot water storage tank 30 is heated to produce hot water. In the hot-water supply operation mode according to the present embodiment, the operation state differs depending on the temperature of outdoor air, that is, the temperature measured by the temperature sensor 75. More specifically, when the temperature of outdoor air is not low, that is, when the temperature measured by the temperature sensor 75 is higher than the first specified temperature, the hot-water supply operation mode according to the present embodiment is in a first hot-water supply operation state in which the heat-source heat exchanger 3 is used as an evaporator and the water heat exchanger 5 is used as a condenser. Moreover, when the temperature of outdoor air is low, that is, when the temperature measured by the temperature sensor 75 is equal to or lower than the first specified temperature, the hot-water supply operation mode according to the present embodiment is in a second hot-water supply operation state in which the water stored in the hot water storage tank 30 is heated by the electric heater 40. Note that a method of setting the first specified temperature is the same as the method in the heating operation mode.

Figure 6:
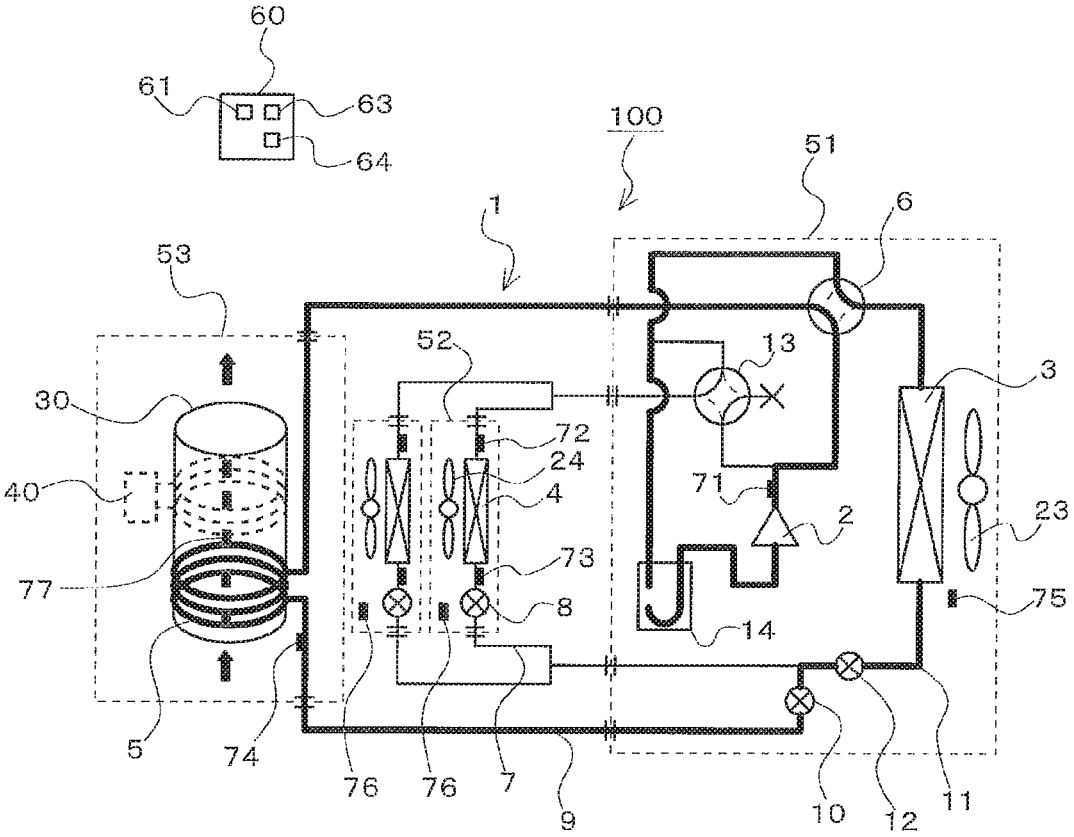
FIG. 6 is a refrigerant circuit diagram illustrating a first hot-water supply operation state in a hot-water supply operation mode of the refrigeration cycle apparatus according to the embodiment of the present disclosure.

FIG. 6 is a refrigerant circuit diagram illustrating the first hot-water supply operation state in the hot-water supply operation mode of the refrigeration cycle apparatus according to the embodiment of the present disclosure. In FIG. 6, the pipes illustrated with bold lines are pipes through which the refrigerant flows.

In the case where the temperature measured by the temperature sensor 75 is higher than the first specified temperature when the hot-water supply operation is to be started, the control section 64 controls the flow path switching device 6, the flow path switching device 13, the expansion valves 8, the expansion valve 10, and the expansion valve 12 on the basis of an initial state of the first hot-water supply operation state in the hot-water supply operation mode stored in the memory 61.

More specifically, the control section 64 switches the flow path of the flow path switching device 6 so that the flow path switching device 6 forms the second flow path represented by the solid lines in FIG. 1. Moreover, the control section 64 switches the flow path of the flow path switching device 13 so that the flow path switching device 13 forms the fourth flow path represented by the solid lines in FIG. 1. The control section 64 sets the opening degree of the expansion valve 10 to an initial opening degree, for example, to an opening degree opened by a specified degree. Moreover, the control section 64 sets the opening degree of each of the expansion valves 8 to a fully closing degree, and the opening degree of the expansion valve 12 to a fully opening degree. Then, the control section 64 activates the compressor 2 and the fans 23 and 24 to start the hot-water supply operation. As the hot-water supply operation is performed, the water heat exchanger 5 is used as a condenser, and the heat-source heat exchanger 3 is used as an evaporator.

Specifically, high-temperature and high-pressure gas refrigerant having been compressed in the compressor 2 passes through the flow path switching device 6 and flows into the water heat exchanger 5, Then, the high-temperature and high-pressure gas refrigerant flowing into the water heat exchanger 5 heats the water stored in the hot water storage tank 30, turns in refrigerant in a liquid state, and flows out of the water heat exchanger 5. The refrigerant flowing out of the water heat exchanger 5 flows into the expansion valve 10. The liquid refrigerant flowing into the expansion valve 10 is decompressed in the expansion valve 10 to be in a low-temperature two-phase gas-liquid state, and flows out of the expansion valve 10.

At this time, the control section 64 controls the opening degree of the expansion valve 10 so that the degree of subcooling of the refrigerant at an outlet of the water heat exchanger 5 is set to a specified value. The degree of subcooling is computed by the computing section 63. More specifically, the computing section 63 computes a condensing temperature of the refrigerant flowing through the water heat exchanger 5 on the basis of a pressure measured by the pressure sensor 71, that is, a value of pressure of the refrigerant discharged from the compressor 2. Moreover, the computing section 63 acquires a temperature measured by the temperature sensor 74, that is, a temperature of the refrigerant flowing out of the water heat exchanger 5. Then, the computing section 63 subtracts the temperature measured by the temperature sensor 74 from the condensing temperature to obtain the degree of subcooling of the refrigerant at the outlet of the water heat exchanger 5. Note that the method of obtaining the degree of subcooling is merely an example. For example, a temperature sensor may be provided at a position in the water heat exchanger 5 at which the two-phase gas-liquid refrigerant flows, and a temperature measured by the temperature sensor may be used as the condensing temperature.

The low-temperature two-phase gas-liquid refrigerant flowing out of the expansion valve 10 passes through the pipe 9, the pipe 11, and the expansion valve 12, and flows into the heat-source heat exchanger 3. The low-temperature two-phase gas-liquid refrigerant flowing into the heat-source heat exchanger 3 absorbs heat from the outdoor air, is caused to be evaporated, and then flows out as low-pressure gas refrigerant from the heat-source heat exchanger 3. The low-pressure gas refrigerant flowing out of the heat-source heat exchanger 3 passes through the flow path switching device 6 and the accumulator 14, and is suctioned into the compressor 2.

Here, as described above, the COP of the refrigeration cycle circuit 1 is lowered when the temperature difference between the refrigerant flowing through the heat-source heat exchanger 3 used as an evaporator and the outdoor air decreases. That is, when the hot-water supply operation is performed in the first hot-water supply operation state under the low outdoor air temperature condition, the COP of the refrigeration cycle apparatus 100 is lowered. Thus, when the temperature of outdoor air is low, that is, when the temperature measured by the temperature sensor 75 is equal to or lower than the first specified temperature, the control section 64 causes the refrigeration cycle circuit 1 to stop and change to the second hot-water supply operation state in which the water stored in the hot water storage tank 30 is heated only by the electric heater 40. In the second hot-water supply operation state, the heating operation can be performed without using the heat-source heat exchanger 3 as an evaporator. The COP of the refrigeration cycle apparatus 100 can therefore be improved as compared with some refrigeration cycle apparatus.

Note that when an amount of hot water supplied to a hot-water supply destination is large, a hot-water supplying load (a load for heating the water in the hot water storage tank 30) may be increased. In such a case, the hot-water supplying load may not be covered in any of the first hot-water supply operation state and the second hot-water supply operation state. Thus, when the hot-water supplying load is larger than a specified value, the refrigeration cycle apparatus 100 according to the present embodiment changes to a third hot-water supply operation state.

Specifically, a target temperature for heating the water stored in the hot water storage tank 30 by the water heat exchanger 5 is stored in the memory 61 of the controller 60. That is, the water stored in the hot water storage tank 30 is heated to the target temperature. When a difference between the target temperature and an actual temperature of the water stored in the hot water storage tank 30 is large, the hot-water supplying load is determined as being large, and the refrigeration cycle apparatus 100 changes to the third hot-water supply operation state. More specifically, the computing section 63 of the controller 60 measures the temperature of the water stored in the hot water storage tank 30 on the basis of the temperatures measured by the temperature sensors 77. Moreover, the computing section 63 subtracts the temperature of the water stored in the hot water storage tank 30 from the target temperature stored in the memory 61. Then, when the subtracted value becomes equal to or exceeds a second specified temperature, the control section 64 causes the refrigeration cycle apparatus 100 to change to the third hot-water supply operation state. That is, when the difference between the target temperature and a temperature measured by the second temperature measurement device becomes equal to or exceeds the second specified temperature, the control section 64 causes the refrigeration cycle apparatus 100 to change to the third hot-water supply operation state.

The third hot-water supply operation state involves an operation that is basically the same as the operation in the first hot-water supply operation state, that is, the operation state illustrated in FIG. 6. Both operation states are different in that, in the third hot-water supply operation state, the electric power is supplied to the electric heater 40. That is, in the third hot-water supply operation state, the water stored in the hot water storage tank 30 is heated by heat received by the heat-source heat exchanger 3 and heat generated by the electric heater 40. With this operation, even when the hot-water supplying load is increased, a hot-water supplying capacity can be prevented from being insufficient.

[Simultaneous Heating and Hot-Water Supply Operation Mode]

The simultaneous heating and hot-water supply operation mode is an operation mode in which the indoor heat exchangers 4 are each used as a condenser to heat the indoor space and heat the water stored in the hot water storage tank 30. That is, the simultaneous heating and hot-water supply operation mode is an operation mode in which the heating operation and the hot-water supply operation are simultaneously performed. Also in the simultaneous heating and hot-water supply operation mode according to the present embodiment, the operation state differs depending on the temperature of outdoor air, that is, the temperature measured by the temperature sensor 75. More specifically, when the temperature of outdoor air is not low, that is, when the temperature measured by the temperature sensor 75 is higher than the first specified temperature, operation of the simultaneous heating and hot-water supply operation mode according to the present embodiment is performed in a first operation state in which the heat-source heat exchanger 3 is used as an evaporator. Moreover, when the temperature of outdoor air is low, that is, when the temperature measured by the temperature sensor 75 is equal to or lower than the first specified temperature, operation of the simultaneous heating and hot-water supply operation mode according to the present embodiment is performed in a second operation state in which the water heat exchanger 5 is used as an evaporator to evaporate the refrigerant flowing through the water heat exchanger 5 using heat generated by the electric heater 40.

Figure 7:
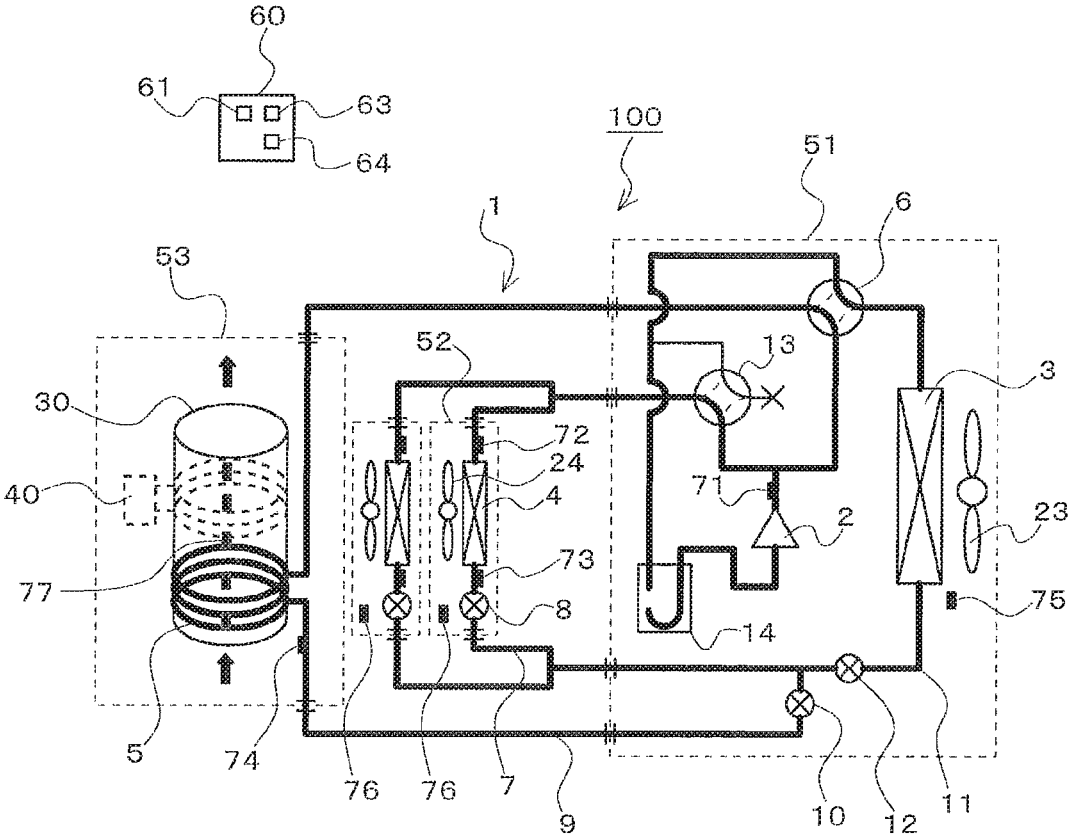
FIG. 7 is a refrigerant circuit diagram illustrating a first operation state in a simultaneous heating and hot-water supply operation mode of the refrigeration cycle apparatus according to the embodiment of the present disclosure.

FIG. 7 is a refrigerant circuit diagram illustrating the first operation state in the simultaneous heating and hot-water supply operation mode of the refrigeration cycle apparatus according to the embodiment of the present disclosure. In FIG. 7, the pipes illustrated with bold lines are pipes through which the refrigerant flows.

In the case where the temperature measured by the temperature sensor 75 is higher than the first specified temperature when the simultaneous heating and hot-water supply operation is to be started, the control section 64 controls the flow path switching device 6, the flow path switching device 13, the expansion valves 8, the expansion valve 10, and the expansion valve 12 on the basis of an initial state of the first operation state in the simultaneous heating and hot-water supply operation mode stored in the memory 61.

More specifically, the control section 64 switches the flow path of the flow path switching device 6 so that the flow path switching device 6 forms the second flow path represented by the solid lines in FIG. 1. Moreover, the control section 64 switches the flow path of the flow path switching device 13 so that the flow path switching device 13 forms the third flow path represented by the dashed lines in FIG. 1. Moreover, the control section 64 sets the opening degree of each of the expansion valves 8 to an initial opening degree, for example, to an initial opening degree that is equal to the initial opening degree of the first operation state in the heating operation mode. Moreover, the control section 64 sets the opening degree of the expansion valve 10 to an initial opening degree, for example, to an initial opening degree that is equal to the initial opening degree of the first hot-water supply operation state in the hot-water supply operation mode. Moreover, the control section 64 sets the opening degree of the expansion valve 12 to a fully opening degree. Then, the control section 64 activates the compressor 2 and the fans 23 and 24 to start the simultaneous heating and hot-water supply operation. As the simultaneous heating and hot-water supply operation is performed, the indoor heat exchangers 4 and the water heat exchanger 5 are used as condensers, and the heat-source heat exchanger 3 is used as an evaporator.

Specifically, part of high-temperature and high-pressure gas refrigerant having been compressed in the compressor 2 passes through the flow path switching device 13 and flows into the indoor heat exchangers 4. Then, the high-temperature and high-pressure gas refrigerant flowing into the indoor heat exchangers 4 heats the indoor air, that is, heats the indoor space, turns in refrigerant in a liquid state, and flows out of the indoor heat exchangers 4. The refrigerant flowing out of the indoor heat exchangers 4 flows into the respective expansion valves 8. The liquid refrigerant flowing into the respective expansion valves 8 is decompressed in the expansion valves 8 to be in a low-temperature two-phase gas-liquid state, and flows out of the expansion valves 8. At this time, the control section 64 controls the opening degree of each of the expansion valves 8 in a manner similar to the manner in the first operation state in the heating operation mode. The low-temperature two-phase gas-liquid refrigerant flowing out of each of the expansion valves 8 passes through the pipe 7, and flows into the pipe 11.

Meanwhile, the remaining part of the high-temperature and high-pressure gas refrigerant having been compressed in the compressor 2 passes through the flow path switching device 6, and flows into the water heat exchanger 5. Then, the high-temperature and high-pressure gas refrigerant flowing into the water heat exchanger 5 heats the water stored in the hot water storage tank 30, turns in refrigerant in a liquid state, and flows out of the water heat exchanger 5. The refrigerant flowing out of the water heat exchanger 5 flows into the expansion valve 10. The liquid refrigerant flowing into the expansion valve 10 is decompressed in the expansion valve 10 to be in a low-temperature two-phase gas-liquid state, and flows out of the expansion valve 10. At this time, the control section 64 controls the opening degree of the expansion valve 10 in a manner similar to the manner in the first hot-water supply operation state in the hot-water supply operation mode. The low-temperature two-phase gas-liquid refrigerant flowing out of the expansion valve 10 passes through the pipe 9, and flows into the pipe 11.

The low-temperature two-phase gas-liquid refrigerant flowing into the pipe 11 passes through the expansion valve 12, and flows into the heat-source heat exchanger 3. The low-temperature two-phase gas-liquid refrigerant flowing into the heat-source heat exchanger 3 absorbs heat from the outdoor air, is caused to be evaporated, and then flows out as low-pressure gas refrigerant from the heat-source heat exchanger 3. The low-pressure gas refrigerant flowing out of the heat-source heat exchanger 3 passes through the flow path switching device 6 and the accumulator 14, and is suctioned into the compressor 2.

Here, as described above, the COP of the refrigeration cycle circuit 1 is lowered when the temperature difference between the refrigerant flowing through the heat-source heat exchanger 3 used as an evaporator and the outdoor air decreases. That is, when the simultaneous heating and hot-water supply operation is performed in the first operation state under the low outdoor air temperature condition, the COP of the refrigeration cycle apparatus 100 is lowered. Thus, when the temperature of outdoor air is low, that is, when the temperature measured by the temperature sensor 75 is equal to or lower than the first specified temperature, the control section 64 causes the refrigeration cycle apparatus 100 to change to the second operation s a e.

The second operation state in the simultaneous heating and hot-water supply operation mode involves an operation that is basically the same as the operation in the second operation state in the heating operation mode, that is, the operation state illustrated in FIG. 3. Both operation states are different in amount of electric power to be supplied to the electric heater 40. In the second operation state in the simultaneous heating and hot-water supply operation mode, the control section 64 causes the electric heater 40 to dissipate heat by the amount larger than the amount of heat given in the second operation state in the heating operation mode. When the amount of heat dissipated by the electric heater 40 is set larger than the amount of heat absorbed by the water heat exchanger 5, the temperature of the water in the hot water storage tank 30 can be raised. In this manner, in the second operation state in the simultaneous heating and hot-water supply operation mode, the simultaneous heating and hot-water supply operation can be performed without using the heat-source heat exchanger 3 as an evaporator. The COP of the refrigeration cycle apparatus 100 can therefore be improved as compared with some refrigeration cycle apparatus.

Note that when the hot-water supplying load or the indoor heating load is increased in the first operation state, both of the hot-water supplying load and the heating load may not be covered only by the heat received by the heat-source heat exchanger 3. Similarly, when the hot-water supplying load or the indoor heating load is increased in the second operation state, both of the hot-water supplying load and the heating load may not be covered only by the heat generated by the electric heater 40. Thus, when the hot-water supplying load or the indoor heating load is increased, the refrigeration cycle apparatus 100 according to the present embodiment changes to a third operation state.

Specifically, a target temperature for heating the water stored in the hot water storage tank 30 by the water heat exchanger 5 is stored in the memory 61 of the controller 60, That is, the water stored in the hot water storage tank 30 is heated to the target temperature. When a difference between the target temperature and an actual temperature of the water stored in the hot water storage tank 30 is large, the hot-water supplying load is determined as being large, and the refrigeration cycle apparatus 100 changes to the third operation state, More specifically, the computing section 63 of the controller 60 measures the temperature of the water stored in the hot water storage tank 30 on the basis of the temperatures measured by the temperature sensors 77. Moreover, the computing section 63 subtracts the temperature of the water stored in the hot water storage tank 30 from the target temperature stored in the memory 61. Then, when the subtracted value becomes equal to or exceeds the second specified temperature, the control section 64 causes the refrigeration cycle apparatus 100 to change to the third operation state, That is, when the difference between the target temperature and a temperature measured by the second temperature measurement device becomes equal to or exceeds the second specified temperature, the control section 64 causes the refrigeration cycle apparatus 100 to change to the third operation state.

A set temperature for heating the indoor space is stored in the memory 61 of the controller 60. When a difference between the set temperature and an actual temperature of the indoor space is large, the heating load is determined as being large, and the refrigeration cycle apparatus 100 changes to the third operation state. More specifically, the computing section 63 of the controller 60 subtracts the temperature measured by each of the temperature sensors 76 from the set temperature stored in the memory 61. Then, when the subtracted value becomes equal to or exceeds the third specified temperature, the control section 64 causes the refrigeration cycle apparatus 100 to change to the third operation state. That is, when the difference between the set temperature and a temperature measured by each of the temperature sensors 76 becomes equal to or exceeds the third specified temperature, the control section 64 causes the refrigeration cycle apparatus 100 to change to the third operation state.

The third operation state involves an operation that is basically the same as the operation in the first operation state, that is, the operation state illustrated in FIG. 7. Both operation states are different in that, in the third operation state, the electric power is supplied to the electric heater 40 and the water stored in the hot water storage tank 30 is heated also by the electric heater 40. In other words, in the third operation state, the heat-source heat exchanger 3 is used as an evaporator, the water heat exchanger 5 is used as a condenser, and the water stored in the hot water storage tank 30 is heated also by the electric heater 40. That is, in the third operation state, the water stored in the hot water storage tank 30 is heated by heat received by the heat-source heat exchanger 3 and heat generated by the electric heater 40. With this operation, even when the hot-water supplying load or the indoor heating load is increased, the hot-water supplying load and the heating load can be prevented from being insufficient.

[Cooling Operation Mode]

Figure 8:
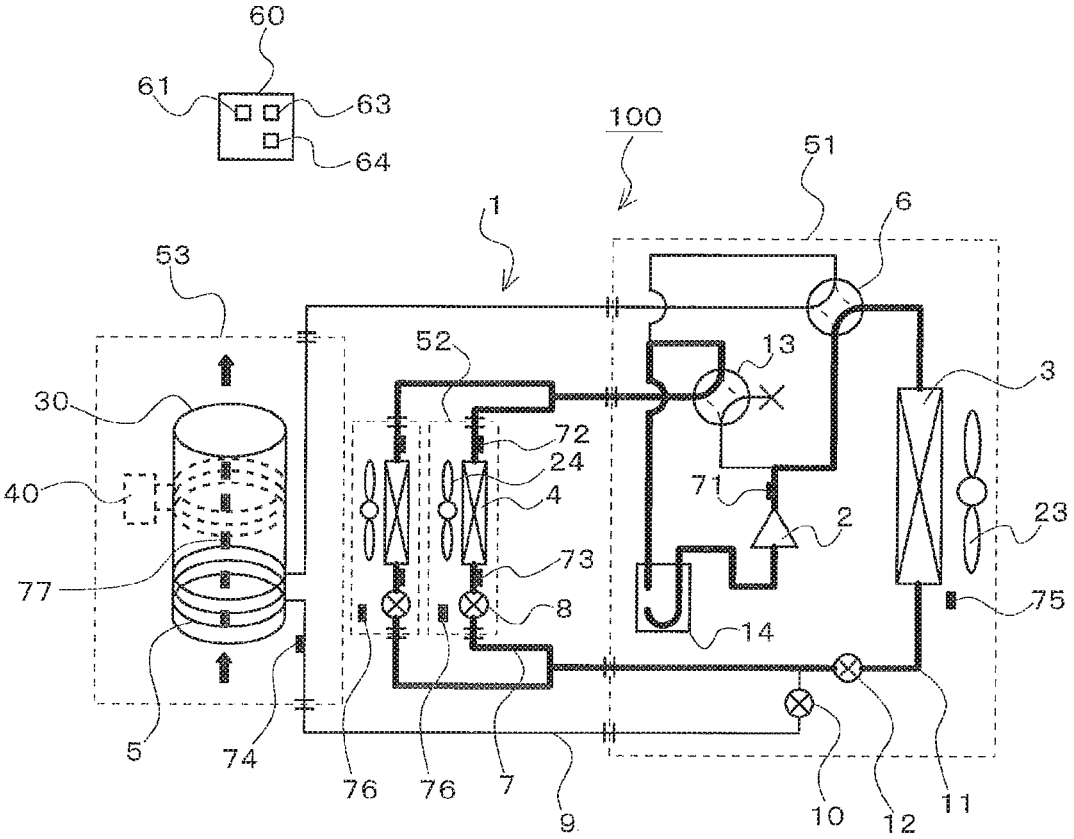
FIG. 8 is a refrigerant circuit diagram illustrating a cooling operation mode of the refrigeration cycle apparatus according to the embodiment of the present disclosure.

FIG. 8 is a refrigerant circuit diagram illustrating a cooling operation mode of the refrigeration cycle apparatus according to the embodiment of the present disclosure. In FIG. 8, the pipes illustrated with bold lines are pipes through which the refrigerant flows.

The cooling operation mode is an operation mode in which the indoor air is cooled by the indoor heat exchangers 4 to cool an indoor space. When the cooling operation is to be started, the control section 64 controls the flow path switching device 6, the flow path switching device 13, the expansion valves 8, the expansion valve 10, and the expansion valve 12 on the basis of an initial state of the cooling operation mode stored in the memory 61.

More specifically, the control section 64 switches the flow path of the flow path switching device 6 so that the flow path switching device 6 forms the first flow path represented by the dashed lines in FIG. 1. Moreover, the control section 64 switches the flow path of the flow path switching device 13 so that the flow path switching device 13 forms the fourth flow path represented by the solid lines in FIG. 1. The control section 64 sets the opening degree of each of the expansion valves 8 to an initial opening degree of the cooling operation mode, for example, to an opening degree opened by a specified degree. Moreover, the control section 64 sets the opening degree of the expansion valve 10 to a fully closing degree, and the opening degree of the expansion valve 12 to a fully opening degree. Then, the control section 64 activates the compressor 2 and the fans 23 and 24 to start the cooling operation. As the cooling operation is performed, the indoor heat exchangers 4 are each used as an evaporator, and the heat-source heat exchanger 3 is used as a condenser.

Specifically, high-temperature and high-pressure gas refrigerant having been compressed in the compressor 2 passes through the flow path switching device 6 and flows into the heat-source heat exchanger 3. Then, the high-temperature and high-pressure gas refrigerant flowing into the heat-source heat exchanger 3 dissipates heat to the outdoor air to be condensed, turns in refrigerant in a liquid state, and flows out of the heat-source heat exchanger 3. The refrigerant flowing out of the heat-source heat exchanger 3 passes through the pipe 11, the expansion valve 12, and the pipe 7, and flows into the expansion valves 8. The liquid refrigerant flowing into the respective expansion valves 8 is decompressed in the expansion valves 8 to be in a low-temperature two-phase gas-liquid state, and flows out of the expansion valves 8.

At this time, the control section 64 controls the opening degree of each of the expansion valves 8 so that the degree of superheat of the refrigerant at an outlet of the corresponding one of the indoor heat exchangers 4 is set to a specified value stored in the memory 61. The degree of superheat is computed by the computing section 63. More specifically, the computing section 63 acquires a temperature measured by each of the temperature sensors 73, that is, an evaporating temperature of the refrigerant flowing through the corresponding one of the indoor heat exchangers 4. Moreover, the computing section 63 acquires a temperature measured by each of the temperature sensors 72, that is, a temperature of the refrigerant flowing out of the corresponding one of the indoor heat exchangers 4. Then, the computing section 63 subtracts the temperature measured by each of the temperature sensors 73 from the temperature measured by the corresponding one of the temperature sensors 72 to obtain the degree of superheat of the refrigerant at the outlet of the corresponding one of the indoor heat exchangers 4. Note that the method of obtaining the degree of superheat is merely an example. For example, a pressure sensor may be provided to the suction port of the compressor 2, and an evaporating temperature may be computed on the basis of a pressure measured by the pressure sensor.

The low-temperature two-phase gas-liquid refrigerant flowing out of each of the expansion valves 8 flows into the corresponding one of the indoor heat exchangers 4. The low-temperature two-phase gas-liquid refrigerant flowing into the indoor heat exchangers 4 cools the indoor air, that is, cools the indoor space, turns in low-pressure gas refrigerant, and flows out of the indoor heat exchangers 4. The low-pressure gas refrigerant flowing out of the indoor heat exchangers 4 passes through the flow path switching device 13 and the accumulator 14, and is suctioned into the compressor 2.

[Simultaneous Cooling and Hot-Water Supply Operation Mode]

Figure 9:
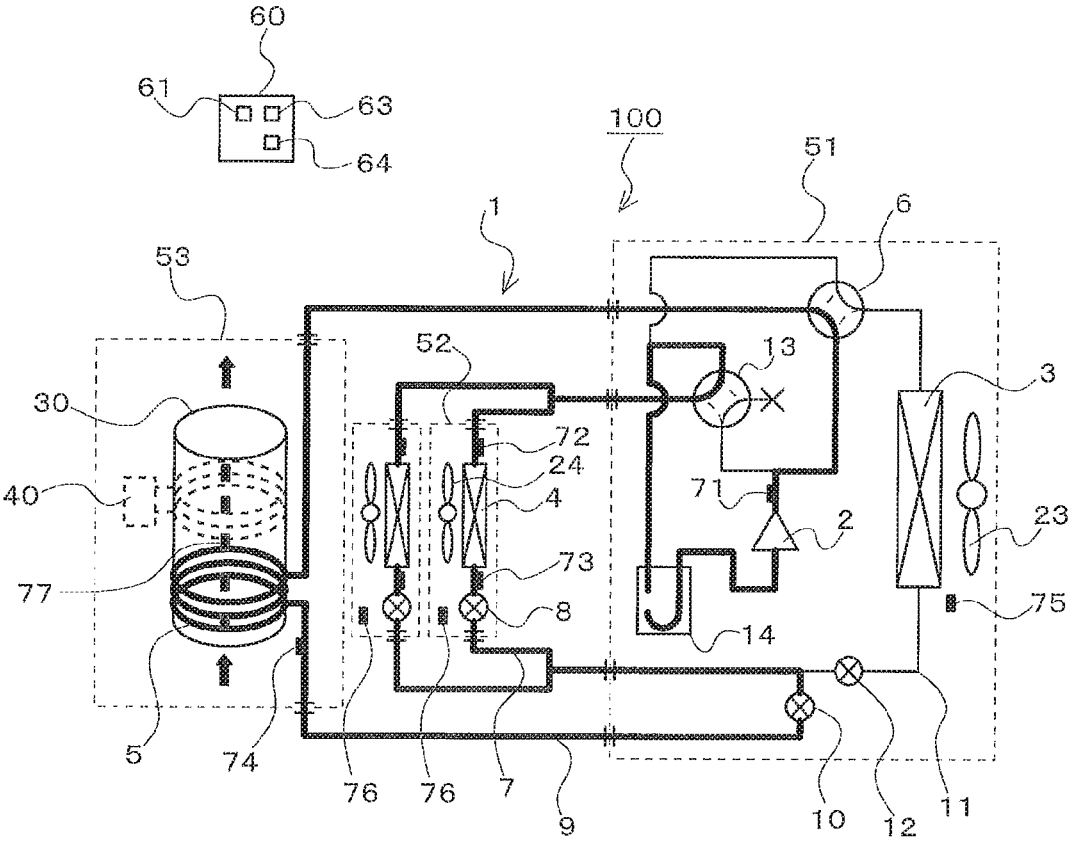
FIG. 9 is a refrigerant circuit diagram illustrating a simultaneous cooling and hot-water supply operation mode of the refrigeration cycle apparatus according to the embodiment of the present disclosure.

FIG. 9 is a refrigerant circuit diagram illustrating a simultaneous cooling and hot-water supply operation mode of the refrigeration cycle apparatus according to the embodiment of the present disclosure. In FIG. 9, the pipes illustrated with bold lines are pipes through which the refrigerant flows.

The simultaneous cooling and hot-water supply operation mode is an operation mode in which the cooling operation and the hot-water supply operation are simultaneously performed. Here, the simultaneous cooling and hot-water supply operation according to the present embodiment is an exhaust-heat recovery operation in which heat having been discharged from the heat-source heat exchanger 3 during the cooling operation is used for heating of the water in the hot water storage tank 30 using the water heat exchanger 5. The heat discharged during the cooling operation can be effectively used, and hence efficiency of the refrigeration cycle apparatus 100 can be improved.

When the simultaneous cooling and hot-water supply operation is to be started, the control section 64 controls the flow path switching device 6, the flow path switching device 13, the expansion valves 8, the expansion valve 10, and the expansion valve 12 on the basis of an initial state of the simultaneous cooling and hot-water supply operation mode stored in the memory 61.

Note that the supply of electric power to the electric heater 40 in the simultaneous cooling and hot-water supply operation mode is optional. For example, the water stored in the hot water storage tank 30 may be heated only using the water heat exchanger 5 without supply of electric power to the electric heater 40. Moreover, for example, the water stored in the hot water storage tank 30 may be heated using both of the water heat exchanger 5 and the electric heater 40 by supplying the electric power to the electric heater 40.

More specifically, the control section 64 switches the flow path of the flow path switching device 6 so that the flow path switching device 6 forms the second flow path represented by the solid lines in FIG. 1. Moreover, the control section 64 switches the flow path of the flow path switching device 13 so that the flow path switching device 13 forms the fourth flow path represented by the solid lines in FIG. 1. The control section 64 sets the opening degree of each of the expansion valves 8 to an initial opening degree of the simultaneous cooling and hot-water supply operation mode, for example, to an opening degree that is equal to the initial opening degree of the cooling operation mode. Moreover, the control section 64 sets the opening degree of the expansion valve 10 to an initial opening degree of the simultaneous cooling and hot-water supply operation mode, for example, to the initial opening degree that is equal to the initial opening degree of the first hot-water supply operation state in the hot-water supply operation mode. The control section 64 sets an opening degree of the expansion valve 12 to a fully closing degree. Then, the control section 64 activates the compressor 2 and the fans 23 and 24 to start the simultaneous cooling and hot-water supply operation. As the simultaneous cooling and hot-water supply operation is performed, the water heat exchanger 5 is used as a condenser, and the indoor heat exchangers 4 are each used as an evaporator.

Specifically, high-temperature and high-pressure gas refrigerant having been compressed in the compressor 2 passes through the flow path switching device 6 and flows into the water heat exchanger 5. Then, the high-temperature and high-pressure gas refrigerant flowing into the water heat exchanger 5 heats the water stored in the hot water storage tank 30, turns in refrigerant in a liquid state, and flows out of the water heat exchanger 5. The refrigerant flowing out of the water heat exchanger 5 flows into the expansion valve 10. The liquid refrigerant flowing into the expansion valve 10 is decompressed in the expansion valve 10 to be in a low-temperature two-phase gas-liquid state, and flows out of the expansion valve 10. At this time, the control section 64 controls the opening degree of the expansion valve 10 in a manner similar to the manner in the first hot-water supply operation state in the hot-water supply operation mode.

The low-temperature two-phase gas-liquid refrigerant flowing out of the expansion valve 10 passes through the pipe 9 and the pipe 7, and flows into the expansion valves 8. The liquid refrigerant flowing into the respective expansion valves 8 is decompressed in the expansion valves 8, and flows out of the expansion valves 8. At this time, the control section 64 controls the opening degree of each of the expansion valves 8 in a manner similar to the manner in the cooling operation mode. The low-temperature two-phase gas-liquid refrigerant flowing out of each of the expansion valves 8 flows into the corresponding one of the indoor heat exchangers 4. The low-temperature two-phase gas-liquid refrigerant flowing into the indoor heat exchangers 4 cools the indoor air, that is, cools the indoor space, turns in low-pressure gas refrigerant, and flows out of the indoor heat exchangers 4. The low-pressure gas refrigerant flowing out of the indoor heat exchangers 4 passes through the flow path switching device 13 and the accumulator 14, and is suctioned into the compressor 2.

As described above, the refrigeration cycle apparatus 100 according to the present embodiment operates in the heating operation mode, the simultaneous heating and hot-water supply operation mode, and the hot-water supply operation mode in the operation states without using the heat-source heat exchanger 3 as an evaporator, even in the low outdoor air temperature condition, which causes lowering of the COP of the refrigeration cycle circuit 1, The COP of the refrigeration cycle apparatus 100 according to the present embodiment can therefore be improved under the low outdoor air temperature condition, as compared with some refrigeration cycle apparatus.

Note that in the present embodiment, in the operation states in all of the operation modes including the heating operation mode, the simultaneous heating and hot-water supply operation mode, and the hot-water supply operation mode, the heat-source heat exchanger 3 is not used as an evaporator under the low outdoor air temperature condition. It is only required, but not limited to, that the heat-source heat exchanger 3 is not used as an evaporator in the operation state under the low outdoor air temperature condition in at least one of the simultaneous heating and hot-water supply operation mode and the hot-water supply operation mode. Even with such a configuration, there can be provided the refrigeration cycle apparatus 100 capable of improving the COP under the low outdoor air temperature condition, as compared with some refrigeration cycle apparatus.

Reference Signs List

| | | |
|---|---|---|
| 1 refrigeration cycle circuit | 2 compressor | 3 heat-source heat exchanger |
| 4 indoor heat exchanger | 5 water heat exchanger | 6 flow path switching device |
| 7 pipe | 8 expansion valve | 9 pipe |
| 10 expansion valve | 11 pipe | 12 expansion valve |
| 13 flow path switching device | 14 accumulator | 23 fan |
| 24 fan | 30 hot water storage tank | 40 electric heater |
| 51 heat source unit | 52 indoor unit | 53 hot water storage tank unit |
| 60 controller | 61 memory | 63 computing section |
| 64 control section | 71 pressure sensor | 72 temperature sensor |
| 73 temperature sensor | 74 temperature sensor | 75 temperature sensor |
| 76 temperature sensor | 77 temperature sensor | 100 refrigeration apparatus |

The invention claimed is:

1. A refrigeration cycle apparatus, comprising:

a hot water storage tank configured to store water;

a heat source provided to the hot water storage tank and configured to heat water stored in the hot water storage tank;

a refrigeration cycle circuit including an indoor heat exchanger, a heat-source heat exchanger, and a water heat exchanger provided to the hot water storage tank and configured to exchange heat with the water stored in the hot water storage tank;

a first temperature sensor configured to measure a temperature in an installation environment of the heat-source heat exchanger; and a controller, the refrigeration cycle circuit including a compressor, a flow path switching valve configured to switch a flow path between a first flow path in which the heat-source heat exchanger is connected to a discharge port of the compressor and the water heat exchanger is connected to a suction port of the compressor and a second flow path in which the heat-source heat exchanger is connected to the suction port of the compressor and the water heat exchanger is connected to the discharge port of the compressor, a first pipe connected to the indoor heat exchanger, a first expansion valve provided to the first pipe, a second pipe connected to the water heat exchanger, a second expansion valve provided to the second pipe, a third pipe having a first end connected to the first pipe and the second pipe and a second end connected to the heat-source heat exchanger, and an open-close valve provided to the third pipe, wherein:

the controller controls the refrigeration cycle apparatus to operate in an operation mode in which the indoor heat exchanger is used as a condenser, when a temperature measured by the first temperature sensor is higher than a first specified temperature, the operation mode is in a first operation state in which the heat-source heat exchanger is used as an evaporator, and when the temperature measured by the first temperature sensor is equal to or lower than the first specified temperature, the operation mode is in a second operation state in which an opening degree of the second expansion valve is set to a fully opening degree, an opening degree of the open-close valve is set to a fully closing degree, the water heat exchanger is used as an evaporator, and refrigerant flowing through the water heat exchanger is evaporated by heat generated by the heat source.

2. The refrigeration cycle apparatus of claim 1, further comprising:

a second temperature sensor configured to measure a temperature of the water stored in the hot water storage tank; and a third temperature sensor configured to measure a temperature of an indoor space, wherein the operation mode is a simultaneous heating and hot-water supply operation mode in which the indoor heat exchanger is used as a condenser to heat the indoor space and heat the water stored in the hot water storage tank, and wherein when a difference between a target temperature for heating the water by the water heat exchanger and a temperature measured by the second temperature sensor is equal to or higher than a second specified temperature or when a difference between a set temperature for heating the indoor space and a temperature measured by the third temperature sensor is equal to or higher than a third specified temperature, the simultaneous heating and hot-water supply operation mode is in a third operation state in which the heat-source heat exchanger is used as an evaporator, the water heat exchanger is used as a condenser, and the heat source heats the water stored in the hot water storage tank.

3. The refrigeration cycle apparatus of claim 1, wherein a hot-water supply operation mode in which the water stored in the hot water storage tank is heated is in a first hot-water supply operation state in which the heat-source heat exchanger is used as an evaporator and the water heat exchanger is used as a condenser, when the temperature measured by the first temperature sensor is higher than the first specified temperature, and in a second hot-water supply operation state in which the heat source heats the water stored in the hot water storage tank, when the temperature measured by the first temperature sensor is equal to or lower than the first specified temperature.

4. The refrigeration cycle apparatus of claim 3, further comprising a second temperature sensor configured to measure a temperature of the water stored in the hot water storage tank, wherein when a difference between a target temperature for heating the water by the water heat exchanger and a temperature measured by the second temperature sensor is equal to or higher than a second specified temperature, the hot-water supply operation mode is in a third hot-water supply operation state in which the heat-source heat exchanger is used as an evaporator, the water heat exchanger is used as a condenser, and the heat source heats the water stored in the hot water storage tank.

5. The refrigeration cycle apparatus of claim 1, wherein:

the heat source comprises an electric heater, and the first specified temperature corresponds to a coefficient of performance of the refrigeration cycle circuit that is in a range from 0.5 to 1.0 inclusive.

6. The refrigeration cycle apparatus of claim 1, wherein:

the heat source comprises a gas boiler, and the first specified temperature corresponds to a coefficient of performance of the refrigeration cycle circuit that is in a range from 1.5 to 3.0 inclusive.

* * * * *